United States Patent [19]

Lohr et al.

[11] 3,931,033

[45] Jan. 6, 1976

[54] LIQUID FOAM-REGULATED NONIONIC DETERGENT COMPOSITIONS

[75] Inventors: Albrecht Löhr, Eggerscheid; Manfred Hennemann, Dusseldorf-Benrath; Günter Jakobi, Hilden, all of Germany

[73] Assignee: Henkel & Cie G.m.b.H., Dusseldorf-Holthausen, Germany

[22] Filed: Dec. 11, 1974

[21] Appl. No.: 531,534

[30] Foreign Application Priority Data

Dec. 14, 1973 Germany ..... 2362114

[52] U.S. Cl. ..... 252/122; 252/118; 252/132; 252/153; 252/170; 252/173; 252/358; 252/546; 252/DIG. 1; 252/DIG. 14

[51] Int. Cl.[2] ..... C11D 1/825; C11D 3/44; C11D 10/04; C11D 17/08

[58] Field of Search ..... 252/89, 111, 114, 118, 252/122, 132, 153, 170, 173, 546, DIG. 1, DIG. 14, 358

[56] References Cited

UNITED STATES PATENTS

| | | | |
|---|---|---|---|
| 2,943,058 | 6/1960 | Cook | 252/153 |
| 2,954,348 | 9/1960 | Schwoeppe | 252/109 |
| 3,037,936 | 6/1962 | Tidridge | 252/139 |
| 3,156,655 | 11/1964 | Bright | 252/109 |
| 3,210,287 | 10/1965 | Kelly | 252/139 |
| 3,367,878 | 2/1968 | Mankowich | 252/139 X |
| 3,679,608 | 7/1972 | Aubert | 252/526 |
| 3,679,609 | 7/1972 | Castner | 252/527 |
| 3,720,621 | 3/1973 | Smeets | 252/540 |
| 3,812,041 | 5/1974 | Inamorato | 252/89 |
| 3,869,399 | 3/1975 | Collins | 252/118 |

*Primary Examiner*—Dennis E. Talbert, Jr.
*Assistant Examiner*—Dennis L. Albrecht
*Attorney, Agent, or Firm*—Hammond & Littell

[57] ABSTRACT

Liquid foam-regulated washing and cleansing agent compositions containing non-ionic surface-active compounds and organic water-miscible solvents of the following composition:

a. 30 to 60 percent by weight of a combination of two ethoxylated alcohols having from 12 to 20 carbon atoms, b. 2 to 6 percent by weight of an alkali metal soap of fatty acids with substantially 12 to 18 carbon atoms, c. 0.1 to 1 percent by weight of a water-soluble organic sequestering agent for heavy metal ions, d. 20 to 35 percent by weight of a water-miscible organic solvent combination of an aliphatic ether alcohol with 5 to 8 carbon atoms and an alkanediol with 2 to 6 carbon atoms, optionally with up to 3 percent by weight of ethanol or isopropyl alcohol, and e. at least 8 percent by weight up to the balance of 100 percent by weight, of water; as well as the method of washing solid articles utilizing the said compositions.

13 Claims, No Drawings

LIQUID FOAM-REGULATED NONIONIC DETERGENT COMPOSITIONS

THE PRIOR ART

The high quality of modern detergents and cleansers, as is well known, is due in a substantial part to the action of the sodium tripolyphosphate contained therein in large amounts. In connection with the increasing eutrophication of standing surface waters, such as lakes and ponds, by insufficiently clarified waste water, whose phosphate content originates partly from these detergents and cleansers, the man skilled in the art is forced to develop new preparations which contain substantially less or no tripolyphosphate.

The known powdered detergents and cleansers contain mostly 30 to 65 percent by weight of sodium tripolyphosphate. In these preparations the sodium tripolyphosphate has the additional function of a solid carrier substance and permits the production of dry pourable granular powders according to the conventional cold and hot spraying methods. Up to a certain degree, surface-active compounds which are in themselves liquid or pasty can also be incorporated in such solid preparations without the powdery aspect of the dried product being considerably changed. These powder preparations have a good solubility even in cold water, particularly if they are produced by spraying an aqueous batch of the components through pressure nozzles in a hot air current where water-soluble particles with a hollow spherical structure are formed.

Faced with the problem of developing a washing and cleansing agent composition without sodium tripolyphosphate, it was therefore self-suggesting for the man skilled in the art to eliminate other solid carrier substances also, and to produce the phosphate-free preparation as a liquid. This also opened the possibility of substantially increasing the content of liquid or pasty surface-active compounds in the liquid preparation.

Among the surface-active compounds of liquid or pasty consistency, there are particularly many nonionic surface-active compounds, especially ethoxylation products of higher fatty alcohols, alkanediols or alkylphenols. Liquid preparations have therefore been frequently described which contain as an active substance substantially the so-called non-ionic surface-active compounds (Non-ionics) and as a solvent large amounts of a low-boiling monohydric alcohol, mostly ethanol or isopropyl alcohol, if necessary mixed with a glycol. These solvents serve to keep the non-ionics and the other liquid or solid preparation components in solution, and to prevent the preparation from gelling.

When liquid Non-ionics are diluted with water, the viscosity increases greatly, as is known, and difficulty dispersible gels are formed (see, for example, American Perfumer and Cosmetics, 82 (1967) 41). This gel-formation impairs to a great extent the use of the Non-ionics as active substances in liquid washing and cleansing agents, since the gel-formation appears particularly when the preparations come in contact with cold water. These preparations can therefore easily lead to the formation of coatings or to clogging in the feeding devices of automatic washing machines. However, even in hand washing the formation of a gel would interfere in the production of the wash liquor and undissolved gel particles could lead to deposits on the washed material and thus to stains.

Lower molecular weight alcohols, such as ethanol and isopropyl alcohol, prevent the undesired formation of gel, if they are used in sufficient amounts as a solvent. However, a liquid preparation with these solvents is not safe enough, particularly for use in the household, because of its relatively low flash point and high vapor pressure. If the lower molecular weight monohydric alcohols are replaced by diols or triols, such as ethylene glycol, propylene glycol (1,2-propanediol) or glycerin, which have also been suggested as solvents for Non-ionics, (see Soap, Perfuming and Cosmetics, 46 (1973) 205), unsatisfactory preparations are likewise obtained which mostly gel in the preparation.

OBJECTS OF THE INVENTION

An object of the invention is to provide liquid washing and cleansing preparations which are easily pourable and stable in storage, but which contain the surfaceactive components in a very high concentration. The preparations according to the invention should, in addition, dissolve readily in cold water; that is, they should dissolve in water of room temperature and below without forming gels or lumps. In addition, the preparations should meet certain safety standards so that they can be safely manufactured, stored, shipped and used; that is, their flash point, vapor pressure and toxicity must be such that they can be handled without special safety measures and precautions.

Another object of the present invention is the development of a liquid foam-regulated washing and cleansing agent composition containing non-ionic surface-active compounds and organic water-miscible solvents consisting essentially of a. from 30 to 60 percent by weight of a combination of two ethoxylated alcohols having from 12 to 20 carbon atoms selected from the group consisting of alkanols, alkenols and mixtures thereof, where one of the two ethoxylated alcohols is adducted with an average of from 2 to 6 mols of ethylene oxide and the other ethoxylated alcohol is adducted with an average of 8 to 20 mols of ethylene oxide, and where the quantitative ratio of the lower ethoxylated alcohol to the higher ethoxylated alcohol is from 1:3 to 1:1;

b. from 2 to 6 percent by weight of an alkali metal soap of fatty acids with substantially from 12 to 18 carbon atoms;

c. from 0.1 to 1 percent by weight of a water-soluble organic sequestering agent for heavy metal ions;

d. from 20 to 35 percent by weight of a water-miscible solvent combination of a monohydric ether alcohol having from 5 to 8 carbon atoms selected from the group consisting of alkoxyalkanols and alkoxyalkoxyalkanols, and a diol having from 2 to 6 carbon atoms selected from the group consisting of alkanediols and alkoxyalkanediols, said alcohol and said diol having boiling points of over 160°C and flash points of over 60°C and the quantitative ratio of said alcohol to said diol being from 2:1 to 1:2, with the proviso that up to 3 percent by weight, based on the total composition, of said monohydric ether alcohol is replaced with a monohydric alcohol selected from the group consisting of ethanol and isopropyl alcohol; and e. at least 8 percent by weight up to the balance of 100 percent by weight, of water.

A yet further object of the present invention is the development of a method of washing solid articles particularly at temperatures of under 60°C using the above washing and cleansing composition.

These and other objects of the invention will become more apparent as the description thereof proceeds.

DESCRIPTION OF THE INVENTION

It has now been found that the problems of the prior art have been solved and the above objects have been achieved with the present invention if certain combinations of non-ionic surface-active compounds are used together with soaps, an organic sequestering agent for heavy metal ions, as well as with organic solvents and water.

The present invention, therefore, concerns liquid foam-regulated washing and cleansing agents. The invention relates particularly to clear homogeneous preparations without builder salts, which are completely free of the usual detergent phosphates and which contain other organic sequestering salts only in small amount necessary to sequester heavy metal ions, and which are suitable as prewashing and principal washing agents for all customary washing machines, but also for washing by hand and for cleaning solid surfaces of all kinds.

The liquid washing and cleansing agent according to the invention is characterized by the following composition:

a. from 30 to 60 percent by weight of a combination of two ethoxylated aliphatic $C_{12}$ to $C_{20}$ alcohols, where one ethoxylation product has an average degree of ethoxylation of 2 to 6, and the other an average degree of ethoxylation of 8 to 20, and where the quantitative ratio of the lower ethoxylated compound to the higher ethoxylated compound is from 1:3 to 1:1;

b. from 2 to 6 percent by weight of a soap, consisting of the alkali metal salts of fatty acids with substantially 12 to 18 carbon atoms;

c. from 0.1 to 1 percent by weight of a water-soluble organic sequestering agent for heavy metal ions;

d. 20 to 35 percent by weight of a water-miscible solvent combination of an alkoxyalkanol or alkoxyalkoxyalkanol with 5 to 8 carbon atoms, and an alkanediol with 2 to 6 carbon atoms whose boiling points are above 160°C and whose flash points are above 60°C, the two solvents being present in a quantitative ratio of 2:1 to 1:2, and where optionally the amount of alkoxyalkanol is replaced up to 3 percent by weight, based on the entire composition by ethanol or isopropyl alcohol; and e. the balance up to 100 percent by weight, but not less than 8 percent by weight of water.

More particularly, the invention relates to a liquid foam-regulated washing and cleansing agent composition containing non-ionic surface-active compounds and organic water-miscible solvents consisting essentially of a. from 30 to 60 percent by weight of a combination of two ethoxylated alcohols having from 12 to 20 carbon atoms selected from the group consisting of alkanols, alkenols and mixtures thereof, where one of the two ethoxylated alcohols is adducted with an average of from 2 to 6 mols of ethylene oxide and the other ethoxylated alcohol is adducted with an average of 8 to 20 mols of ethylene oxide, and where the quantitative ratio of the lower ethoxylated alcohol to the higher ethoxylated alcohol is from 1:3 to 1:1;

b. from 2 to 6 percent by weight of an alkali metal soap of fatty acids with substantially from 12 to 18 carbon atoms;

c. from 0.1 to 1 percent by weight of a water-soluble organic sequestering agent for heavy metal ions;

d. from 20 to 35 percent by weight of a water-miscible solvent combination of a monohydric ether alcohol having from 5 to 8 carbon atoms selected from the group consisting of alkoxyalkanols and alkoxyalkoxyalkanols, and a diol having from 2 to 6 carbon atoms selected from the group consisting of alkanediols and alkoxyalkanediols, said alcohol and said diol having boiling points of over 160°C and flash points of over 60°C and the quantitative ratio of said alcohol to said diol being from 2:1 to 1:2, with the proviso that up to 3 percent by weight, based on the total composition, of said monohydric ether alcohol is replaced with a monohydric alcohol selected from the group consisting of ethanol and isopropyl alcohol; and e. at least 8 percent by weight up to the balance of 100 percent by weight, of water.

The liquid washing and cleansing agent according to the invention is homogeneous and easily pourable. It represents a new combination of known substances and has an excellent cleansing power. The preparation is characterized by insensitivity to hard water in the washing of textiles of various fibers of natural or synthetic origin, and, because of its foam regulation reliability over the entire washing temperature range, it is suitable for use in all conventional washing machines.

The new preparation is particularly suitable for washing up to 60°C in the one liquor washing method for washing machines, but also for drum washing machines. However, it can also be used with excellent results in the two-liquor washing methods as a preliminary washing agent instead of the known triphosphate-rich powdered preparations, followed by washing with a conventional full range detergent and the subsequent rinsing, without the undesired excessive sudsing during the subsequent clear washing, because of the wash liquor still existing from the preliminary washing. A perborate-free detergent, which can be used for all textiles and washing methods up to 60°C as well as for the preliminary washing before boiling is known in general as a main or primary detergent. In addition, the new preparation is highly suitable for cleaning solid surfaces, such as dishes, floors, sanitary installations, tiles, glass, car bodies, containers soiled with oil, etc.

Due to the good water-solubility of the preparation according to the invention even in cold water below room temperature, the dosing through the feeding devices of the washing machines, which are suitable for the addition of liquid detergents, poses no problem. Naturally the dosed amount of detergent can also be added directly to the material to be washed. Because of its good cold water-solubility, the preparation is also excellently suitable for hand-washing in wash basins, tubs, etc. where the wash water has generally temperatures between 15° and 40°C.

The excellent cleaning power of the new preparation is based substantially on the combination of surfaceactive compounds or tensides used according to the invention, which consists of a mixture of two ethoxylation products with a different degree of ethoxylation, and which is obtained by mixing the separately produced ethoxylation products.

These ethoxylation products are produced in known manner from the corresponding aliphatic alcohols with chain lengths between $C_{12}$ and $C_{20}$ by reaction with ethylene oxide, where alcohols, particularly alkanols and alkenols with chain lengths between $C_{12}$ and $C_{20}$ are used primarily as the aliphatic alcohols.

Preferably used in the tenside combination, because of their particularly good biodegradability, are the ethoxylation products of the straight-chained primary alkanols and alkenols with chain lengths between $C_{12}$ and $C_{18}$, where the alcohol radicals can be both of natural and of synthetic origin. Suitable and readily available starting materials are natural higher fatty alcohols, for example, a mean cut of coconut oil fatty alcohols with mainly $C_{12}/C_{14}$ alkyl radicals and tallow oil fatty alcohols with mainly $C_{16}/C_{18}$ alkyl and alkenyl radicals. But the ethoxylation derivatives of the Oxoalcohols, obtained by hydroformylation of olefins, or the alcohols of the corresponding chain lengths obtained by oxidation of paraffins, are also suitable for use in the tenside combination according to the invention.

A good cleaning effect combined with a good biodegradability is obtained if the ethoxylation products from the primary and straight-chained $C_{12}$ to $C_{18}$ alkanols or alkenols have an average degree of ethoxylation of 3 to 5 for the lower ethoxylated products, and an average degree of ethoxylation of 10 to 15 for the higher ethoxylated products.

The optimum cleaning action of the preparation is also influenced by the mixing ratio of the two non-ionic surface-active compounds with a different mean degree of ethoxylation. It was found that an optimum cleaning effect is obtained when the mixing ratio of the two non-ionic tensides in the surfactant-combination (a) with a lower and higher average degree of ethoxylation is, as indicated, in the range of 1:3 to 1:1, preferably in the range of 1:2 to 1:1.

Typical representatives of lower ethoxylated aliphatic $C_{12}$ to $C_{20}$ alcohols that can be used according to the invention are the products: coconut fatty alcohols + 3EO, tallow fatty alcohol +5EO, oleyl/cetyl alcohol + 5EO, lauryl alcohol +3EO, $C_{12}/C_{14}$ synthetic fatty alcohol + 4.5EO, $C_{12}/C_{16}$ synthetic fatty alcohol + 6EO, $C_{11}$ to $C_{15}$ oxoalcohol + 3EO, etc. Examples of higher ethoxylated aliphatic $C_{12}$ to $C_{20}$ alcohols are: lauryl alcohol +8EO, coconut fatty alcohol + 12EO, $C_{12}/C_{14}$ synthetic fatty alcohol +9EO, oleyl/cetyl alcohol +10EO, tallow fatty alcohol + 14EO, $C_{11}$ to $C_{15}$ oxoalcohol + 13EO, $C_{15}$ to $C_{18}$ oxoalcohol + 18EO, etc.

The soaps used according to the invention are ordinarily the sodium and potassium salts of individual fatty acids or fatty acid mixtures of the chain lengths of $C_{12}$ to $C_{18}$. The fatty acids can be saturated or unsaturated, and can contain small amounts of fatty acids outside the above range as might occur in the natural fats. Particularly suitable are fatty acid mixtures derived from natural sources, such as the fatty acids obtained from coconut oil or tallow oil. The soap content of the preparations according to the invention serves to regulate foam development in the wash liquors. The foam-inhibiting effect of the soap is particularly noticeable when the preparations are used as preliminary or main detergents in washing machines. Undesired foam formation is then effectively prevented during the washing cycle proper and during the rinsing out of the wash liquor. The soaps are easily soluble in the aqueous-alcoholic medium of the preparation according to the invention. They can therefore be readily incorporated in the indicated amounts in the form of the potassium as well as the more difficultly soluble sodium salts.

The soap must be considered as the essential salt-containing component of the preparation, together with the sequestering agent which is present in a small amount. The alkalinity of the liquid product, which has a pH value of 11 to 12 in the undiluted state, is therefore due primarily to the amount of soap contained therein. For aqueous dilutions of the preparations, as they are generally used as wash liquors for textiles; that is, from 1 to 2 percent solutions of the preparation, a pH value in the range of 7.7 to 9 is obtained. This value often drops, however, to 7.3 to 8 at the end of the washing cycle.

The combination according to the invention of organic solvents (d) according to the above definition has the effect, together with the water portion of the formula, that the liquid preparations are highly stable in storage, and that their liquid consistency is not permanently changed even by temporary extreme temperature fluctuations. For example, after cooling to 0°C or below, as it can happen in winter when they are stored in unheated rooms, the preparation appears again in its original quality after defrosting. Another advantage due to the solvent combination is the good cold water solubility of the liquid preparations, which makes it possible to use them without any difficulties even in cold wash water without the gel formation typical of Non-ionics which occur in contact with the wash water.

To make sure that the preparations represent clear and homogeneous liquids, the water portion of the preparations should not be less than 8 percent by weight. A water demineralized, for example, by distillation or ionexchange, is preferred over ordinary tap water in the production of the preparations.

From a safety point of view, the use of the combination of organic solvents according to the invention with flash points over 60°C together with the water portion of the preparation has the effect that a flash point below 100°C (method by Pensky-Martens) is not found for the preparation.

Suitable alkoxyalkanols or alkoxyalkoxyalkanols with 5 to 8 carbon atoms, and with boiling points over 160°C and flash points over 60°C are, for example, the compounds n-butoxyethanol (n-butyl-glycol), methoxyethoxyethanol (methyl diglycol), ethoxyethoxyethanol (ethyl diglycol), propoxyethoxyethanol (propyl diglycol), and n-butoxyethoxyethanol (n-butyl diglycol). One component of the solvent combination according to the invention is composed of these and similar ether alcohols.

The second component of the solvent combination according to the invention is composed of alkanediols having from 2 to 6 carbon atoms, as well as alkoxyalkanediols having from 2 to 6 carbon atoms, which means that the alkyl radical in the compound can also be interrupted by ether groups. Examples of such compounds, which likewise have boiling points over 160°C and flash points over 60°C are ethylene glycol, diethylene glycol, propylene glycol, (1,2-propanediol), trimethylene glycol (1,3-propanediol), dipropylene glycol (dimeric 1,2-propanediol), as well as glycerin monomethyl ether and glycerin monoethyl ether.

The liquid preparations produced with the solvent combination according to the invention are characterized by good storability, easy cold water solubility, and difficult combustibility. They are clear, homogeneous and easily pourable, despite the high concentration of surface-active compounds.

An optimum combination of the cleansing properties and ease of production of the liquid preparations according to the invention is observed if the content of tenside combination (a), foam inhibitor (b), and sequestering agent (c), as defined above, is characterized by the following amounts:

a. from 35 to 45 percent by weight of a combination of two ethoxylated aliphatic $C_{12}$ to $C_{20}$ alcohols, preferably primary, straight-chained alkanols and alkenols with 12 to 18 carbon atoms, where one ethoxylation product has an average degree of ethoxylation of 2 to 6, preferably 3 to 5, and the other has an average degree of ethoxylation of 8 to 20, preferably 10 to 15, and where the quantitative ratio of the lower ethoxylated compound to the higher ethoxylated compound is 1:3 to 1:1, preferably 1:2 to 1:1;

b. from 4 to 6 percent by weight of a soap, consisting of the alkali metal salts of fatty acids with substantially 12 to 18 carbon atoms;

c. from 0.3 to 0.5 percent by weight of a water-soluble organic sequestering agent for heavy metal ions.

Preferably, the above defined solvent combination (d) represents from 25 to 30 percent by weight of the preparations. Preparations with a particularly good cold water solubility and storage stability contain a solvent combination (d) of a monohydric ether alcohol and a diol in a quantitative ratio of 3:2. Particularly preferred as the ether alcohol is the compound n-butoxyethoxyethanol (n-butyl diglycol), and as alkanediol, the compound propylene glycol (1,2 propanediol). A liquid preparation produced with these solvents according to the invention has not only the above mentioned favorable properties, it also is practically odorless. The absence of a specific odor in the preparation is particularly of advantage when it is used at elevated temperatures, for example, when washing at 60°C in the washing machine. During the washing, and particularly during the draining of a hot wash liquor through an open outlet, the specific odor of the detergent components may be noticed in the room. It is therefore an advantage of the liquid detergent according to the invention that the wash liquors prepared with it give off practically no solvent vapors to the outside, due to the low partial vapor pressure of the solvents, and are not annoying for the user due to the absence of a characteristic odor.

The favorable acceptance of a washing and cleansing agent by the user may depend on whether the products have a pleasant smell. The commercial detergents and cleansers therefore contain perfumes which have to perform four different functions, particularly in detergents. Undoubtedly they should first of all impart to the powdered or liquid product a pleasant smell. Beyond that, however, they also have to hide or mask the unpleasant odors of the wash liquor frequently appearing during the washing, and finally accompany the washing result in the freshly washed wet wash and in the dry wash by an impression of cleanliness and freshness.

Liquid products have a substantially smaller surface area than powdered preparations, and larger amounts of perfumes are therefore required to achieve the same odor intensity in liquid products as in powdered products. A given amount of perfume, which is found to be pleasant in a liquid product, would impart to the wash liquor as well as to the textiles washed with it a too strong odor after the dissolution of the preparation.

It was found that these perfuming problems can be solved if a part of the aliphatic monohydric ether alcohol or alkoxy alkanol of the solvent combination according to the invention, namely up to an amount of 3 percent by weight based on the total preparation, is replaced by ethanol or isopropyl alcohol. This small amount changes the odor impression of the liquid product according to the invention in such a way that a sufficient odor intensity is already achieved for the liquid concentrate with perfume amounts which are sufficient for powdered products; that is, it is possible this way to use from 0.15 to 0.25 percent by weight, instead of 0.4 to 0.5 percent by weight, of perfume.

A content of more than 3 percent by weight of ethanol or isopropyl alcohol should be avoided, however, because then not only will the characteristic odor of these alcohols be noticed, but the flash point of the liquid preparation will drop to a temperature which is no longer acceptable for safety reasons.

Preparations according to the invention which contain up to 3 percent by weight ethanol or isopropyl alcohol have a flash point which is between 60° and 70°C for the finished preparation. If such preparations are diluted with water to the concentrations customary for washing, the wash liquors thus obtained have a flash point which is above 100°C. The preparations with an ethanol or isopropyl alcohol content of up to 3 percent by weight are thus much safer than known liquid detergents which contain these low boiling alcohols in larger amounts as principal solvents. Cold water solubility and storage stability of the detergents according to the invention are practically not affected by this small amount of ethanol or isopropyl alcohol.

The preparations according to the invention furthermore contain in small amount of from 0.1 to 1 percent by weight of a water-soluble organic sequestering agent for heavy metal ions as component (c). Preferably these water-soluble organic sequestering agents for heavy metal ions are selected from the group consisting of (1) the aminopolyalkylene carboxylic acids, (2) the alkanepolyphosphonic acids, (3) the aminoalkanepolyphosphonic acids, (4) the hydroxy alkanepolyphosphonic acids, (5) the aminopolyalkylenepolyphosphonic acids, and their alkali metal salts. Typical examples of such sequestering agents are nitrilotriacetic acid, ethylenediaminetetraacetic acid, diethylenetriaminepentaacetic acid, methanediphosphonic acid, dimethylamino-methane-1,1-diphosphonic acid, aminotrimethylenetriphosphonic acid, 1-hydroxethane-1,1-diphosphonic acid, etc. The sequestering agents are preferably used in the form of their water-soluble sodium or potassium salts.

Sequestering agents for heavy metal ions are characterized by their much greater sequestering power for the ions of the heavy metals, which are primarily iron, copper, manganese and nickel, than for alkaline earth ions, such as calcium and magnesium, which are also responsible for the hardness of ordinary tap water. These sequestering agents yield therefore stable complexes with the heavy metal ions, even in the presence of alkaline earth ions, where the amount of the sequestering agents is not sufficient to sequester all the metal ions.

The formation of the complexes eliminates the undesired catalytic activity of the free heavy metallions. Thus, for example, the soap component is protected by the sequestering agent from becoming rancid, and oxidation of the optical brighteners is prevented. The formation of the colorless heavy metal complexes also prevents the undesired discoloring of the preparation by traces of heavy metal ions, which can get into the preparation during the manufacture, and the yellowing of the washed material caused by iron ions derived from the wash liquor.

In order to mask or separate the heavy metal ions which can be present in traces in the basic components of the liquid preparation, in the tap water used for washing and in the soil, small amounts of sequestering agents, of the order of from 0.1 to 0.3 percent by weight, are sufficient. Under certain circumstances it may be necessary to increase the sequestering agent content up to 1% by weight, particularly when the water used for washing has an extremely high iron content, or when mixing apparatus, pipe lines or storage tanks of metal are used in the large-scale production of the liquid preparation.

The low content of sequestering agents in the preparations makes it clear that it is not intended to sequester the hardness formers of the wash water, since this would require much larger amounts of sequestering agents. It is therefore another advantage of the invention that no other sequestering agents have to be present, except for the small amount necessary to sequester the heavy metal ions, in order to obtain a good cleaning effect even in hard water.

Preferably, so-called optical brighteners are added to the preparations according to the invention, just as in most modern detergents, in order to further increase the impression of whiteness of the clean and, if necessary, bleached wash. Because of the great number of different fibers used today, and the specific affinity which the various optical brighteners have to certain types of fibers, several optical brighteners are mostly used jointly to obtain a good brightening effect, for the mostly used fibers, such as cotton, polyamide, polyester and blended fabrics.

The detergents can contain particularly derivatives of diaminostilbene-disulfonic acid or its alkali metal salts as the optical brighteners for cotton. Suitable, for example, are salts of 4,4'-bis-(2-anilino-4-morpholino-1,3,5-triazin-6-yl-amino)-stilbene-2,2'-disulfonic acid, or similarly structured compound which carry instead of the morpholino group, a diethanolamino group, a methylamino group, or a 2-methoxyethylamino group. The brighteners for polyamide fibers which can be used as those of the type of the 1,3-diaryl-2-pyrazolines, for example, the compound 1-(p-sulfamoylphenyl)-3-(p-chlorophenyl)-2-pyrazoline, as well as similarly structured compounds which carry instead of the sulfamoyl group, for example, the methoxycarbonyl group, the 2-methoxyethoxycarbonyl group, the acetylamino group or the vinylsulfonyl group. Suitable polyamide brighteners are also the substituted aminocumarines, for example, 4-methyl-7-dimethylamino-cumarine or 4-methyl-7-diethylamino-cumarine. Furthermore the compounds 1-(2-benzimidazolyl)-2-(1-hydroxyethyl-2-benzimidazolyl)-ethylene and 1-ethyl-3-phenyl-7-diethylamino-carbostyril can be used as polyamide brighteners. Brighteners for polyester and polyamide fibers are, for example, the compound 2,5-di-(2-benzoxazolyl)-thiophene,2-(2-benzoxazolyl)-naptho-[2,3-b]-thiophene and 1,2-di-(5-methyl-2-benzoxazolyl)-ethylene. Also suitable are brighteners of the type of the substituted 4,4'-distyryldiphenyls, for example, the compound 4,4'-bis-(4-chloro-3-sulfostyryl)-diphenyl. Mixtures of the above mentioned brighteners can also be used.

The optical brighteners can be contained in the preparations according to the invention in amounts of from 0.1 to 0.4 percent by weight. As far as the optical brighteners are salt-like, they are used in the form of the free acid or of their readily soluble salts, particularly the alkali metal salts. The incorporation both of the salt-like and of the non-ionogenic optical brighteners in the preparations according to the invention is readily possible since they are sufficiently soluble in the aqueous-alcoholic system of the preparations.

Furthermore, other washing agent auxiliaries can be added in small amounts to the preparations, such as, preservatives, anti-microbial compounds, dyes, and perfumes. If desired, a pearly luster of turbidizing substance, such as ethylene glycol-distearate can be incorporated in the preparations.

Preservatives can be added to protect the liquid preparations against bacterial decomposition. Suitable active substances are, for example, benzoic acid, salicylic acid, sorbic acid or aqueous formaldehyde solution. For preservation purposes, it suffices to add these substances in amounts of from 0.1 to 0.3 percent by weight, based on the total liquid product.

An extensive antimicrobial action is obtained if antimicrobial substances which are soluble in the preparations are added, and which display during the washing and cleansing process an additional bactericidal or bacteriostatic or fungicidal or fungistatic effect on the substrate, thus enhancing the cleaning action proper of the tensides. As known, washing temperatures of up to 60°C, at which the preparations according to the invention are to be mainly used, are not sufficient to kill or inhibit all the existing germs so that the addition of antimicrobial substances may be desirable for hygienic reasons.

Quaternary ammonium compounds can be used as antimicrobial substances which have, in addition to one long-chained and two short-chained alkyl radicals generally a benzyl or allyl radical, such as the compounds dimethylbenzyl-dodecyl-ammonium chloride or dibutylallyl-dodecylammonium chloride. Suitable are also the halogenated phenolic compounds of the type of the halogenated alkylenebisphenols, the hydroxybenzoic acid derivatives and the phenoxy-phenols, known as antimicrobial compounds. These compounds, if used, may be employed in amounts up to 1 percent by weight of the preparation.

The liquid preparations according to the invention can be produced in a simple manner by mixing the components in conventional mixing apparatus. It is not necessary to maintain a certain sequence for the addition of the individual components. The mixing of the components can be effected at room temperature, but it can be accelerated at elevated temperatures. Additives like perfumes and preservatives are added to the preparation with advantage at room temperature. Details of the process of the manufacture of the washing and cleansing compositions of the invention are given in the Examples which follow.

When washing textiles, for which the liquid preparations according to the invention are particularly suitable, a good washing effect is achieved both in hard and in soft water and at washing temperatures which are at room temperatures or below; that is, the water hardness of the wash liquors can be in the range of 0° – 30°dH (dH=degrees German hardness = 0 to 300 ppm calcium oxide) and the temperature of the wash liquor can vary between 10° and 60°C. The washing is generally effected in an automatic washing machine. The liquid preparation is also suitable, however, for washing by hand. For stubborn stains, it may be of advantage to apply the liquid undiluted preparation directly on the dry textile, if otherwise difficult stains or spots are to be washed out. For ordinary washing of textiles, the liquid preparation of the invention are employed in dilutions with wash liquor of 1:40 to 1:200, preferably 1:50 to 1:100.

The washing effect and the greying behavior (maintenance of whiteness) of the preparation were compared with the conventional phosphate-containing detergents. In these comparison tests the visual evaluation of the washing results showed an equally good and partly even better evaluation of the preparation according to the invention, and in the case of the determination of the whiteness effect, the subjective evaluations could be verified by measurement of the remission values with a photometer.

The following specific embodiments are illustrative of the practice of the invention without being limitative in any respect.

EXAMPLES

In the manufacture of the preparations under laboratory conditions, as well as on a technical scale, the following procedure was found particularly expedient.

First the sequestering agent, then the soap was dissolved in demineralized water with stirring and heating to about 40° to 60°C. Preferably, the fatty acid and the calculated amount of alkali metal hydroxide were added separately instead of the soap, the alkali metal hydroxide being dissolved first and then the fatty acids were added. By this procedure, preparation with a less pronounced natural color were obtained, as compared to those obtained with the addition of a finished soap. The organic solvents were mixed with the clear batch, then the optical brighteners were added and dissolved with stirring. Subsequently, the two non-ionic surface-active compounds were added and the solution thus obtained was cooled to room temperature. The dye or colorant was dissolved either in a partial amount of the ether alcohol which has been retained or in the portion of ethanol or isopropyl alcohol provided, and this solution as well as the preservative and the perfume are added to the cooled batch with stirring.

EXAMPLE 1

| | Percent by Weight |
|---|---|
| oleyl/cetyl alcohol (alcohol iodine number 50) + 5 EO | 20 |
| oleyl/cetyl alcohol (alcohol iodine number 50) + 10 EO | 20 |
| fatty acid mixture (5% by weight $C_{12}$, 6% by by weight $C_{14}$, 31% by weight $C_{16}$, 58% by by weight $C_{18}$; iodine number 45) | 5.55 |
| sodium hydroxide | 0.83 |
| 2-(2-n-butoxyethoxy)-ethanol ("Butyl Carbitol") | 15 |
| propylene glycol (1,2-propanediol) | 10 |
| sodium ethylenediaminetetraacetate | 0.5 |
| cotton brightener I (4,4'-bis-(2-anilino-4-morpholino-1,3,5-triazin-6-yl-amino)-stilbene-2,2'-disulfonic acid-sodium salt) | 0.06 |
| cotton brightener II (4,4'-bis-(2-anilino-4-methyl-amino-1,3,5-triazin-6-yl-amino)-stilbene-2,2'-disulfonic acid-sodium salt) | 0.06 |
| dye | 0.0012 |
| perfume | 0.4 |
| formalin (37%) | 0.1 |
| distilled water balance up to | 100 |

EO = mols of ethylene oxide adducted to the alcohol

For the production of the liquid preparation, the distilled water was charged and the sodium ethylenediaminetetraacetate and sodium hydroxide were dissolved therein. Then the fatty acid mixture was added with stirring and the mixture was heated to 60°C. After the batch had become clear, the organic solvents butoxyethoxyethanol and propylene glycol were stirred in. About one-fifth of the total amount of the butoxyethoxyethanol was retained, however, and the dye was dissolved therein separately. After adding the organic solvents, the optical brighteners and then the two non-ionic surfactants were added. A clear solution was obtained which was cooled to room temperature and then mixed under stirring with the dye solution, the formalin solution and the perfume. The following physical characteristics were determined for the preparation thus obtained:

| | |
|---|---|
| viscosity | 93 cP (Brookfield 20°C) |
| density (20°C) | 1.000 g/ml |
| pH-value | 11.5 |
| flash point | over 100°C (according to DIN 51,758) |

EXAMPLE 2

The composition of the preparation corresponds to that of Example 1, with the exception of the combination of the organic solvents. The solvent combination used (related to the total amount) was:

| | |
|---|---|
| butoxyethoxyethanol | 12% by weight |
| propylene glycol | 10% by weight |
| isopropyl alcohol | 3% by weight |

The production was effected as described in Example 1. The dye was dissolved in the isopropyl alcohol and added to the cooled preparation together with the preservative and the perfume. 0.2 percent by weight of the perfume were sufficient in this instance.

| Characteristics of the preparation: | |
|---|---|
| viscosity | 85 cP (Brookfield, 20°C) |
| density (20°C) | 0.997 g/ml |
| pH-value | 11.3 |
| flash point | 62°C (according to DIN 51,755): when diluted with water 1:50, the flash point is above 100°C. |

The liquid preparations according to Examples 1 and 2 were clear and easily pourable. A homogeneous solution was obtained immediately when they were poured into cold tap water of 13°c (40 ml of preparation, 300 C of water) and stirred with a glass rod (stirring time about 1 second)

The properties of the preparations were not permanently changed by prolonged storage under extreme temperature conditions (+5°C to +60°C).

Other liquid preparations according to the invention whose properties are comparable to those of Examples 1 and 2, and which can be produced in a similar manner, will be described in the following Table I. The following designations and abbreviations respectively are used for the components. The components in their form of salts, unless explicitly indicated otherwise, are present as the sodium salts. "CA+3EO," "CA+12EO," "TA+5EO," "TA+14EO," "OCA+5EO," OCA+10EO" the addition products of 3, 5, 10, 12 and 14 mols of ethylene oxide (EO) adducted on 1 mol of technical coconut alcohol (CA) or tallow alcohol (TA) or oleyl-cetyl alcohol (iodine number 50) (OCA).

"Soap A": a soap produced in situ from a tallow fatty acid mixture of about 5% by weight $C_{12}$, 6% by weight $C_{14}$, 31% by weight $C_{16}$, and 58% by weight $C_{18}$ (iodine number 45).

"Soap B": a soap produced in situ from the $C_{12}$ to $C_{14}$ fatty acids of coconut oil (iodine number 2)

"EDTA", "NTA": the sodium salts of ethylenediaminetetraacetic acid and nitrilo-triacetic acid.

"Cotton brightener": a compound of the formula 4,4'-bis-(2-anilino-4-morpholino-1,3,5-triazin-6-yl-amino)-stilbene-2,2'-disulfonic acid-sodium salt.

"Polyamide brightener": a compound of the formula 1-(p-sulfamoyl-phenyl)-3-p-chlorophenyl)-2-pyrazoline.

The washing effect and the greying behavior (maintenance of whiteness) of the preparation were compared with the conventional phosphate-containing detergents. In these comparison tests the visual evaluation of the washing results showed an equally good and partly even better evaluation of the preparation according to the invention, and in the case of the determination of the whiteness effect, the subjective evaluations could be verified by measurement of the remission values with a photometer.

The preceding specific embodiments are illustrative of the practice of the invention. It is to be understood, however, that other expedients known to those skilled in the art or disclosed herein may be employed without departing from the spirit of the invention or the scope of the appended claims.

TABLE I

| Component of Preparation | % by weight of the component according to example | | | | | | |
|---|---|---|---|---|---|---|---|
| | 3 | 4 | 5 | 6 | 7 | 8 | 9 |
| CA + 3 EO | — | — | — | 20.0 | — | — | — |
| CA + 12 EO | — | — | 20.0 | — | — | — | — |
| TA + 5 EO | — | — | 20.0 | — | — | — | — |
| TA + 14 EO | — | 20.0 | — | — | — | — | — |
| OCA + 5 EO | 30.0 | 20.0 | — | — | 15.0 | 20.0 | 20.0 |
| OCA + 10 EO | 30.0 | — | — | 20.0 | 15.0 | 20.0 | 20.0 |
| Soap A | 6.0 | 6.0 | 6.0 | — | — | 6.0 | 6.0 |
| Soap B | — | — | — | 6.0 | 2.0 | — | — |
| EDTA | 0.5 | 0.5 | 0.5 | 0.5 | 0.3 | — | 0.5 |
| NTA | — | — | — | — | — | 1.0 | — |
| Butoxyethanol | — | — | — | — | — | — | — |
| Ethoxyethoxyethanol | — | — | — | — | — | — | — |
| Butoxyethoxyethanol | 12.0 | 12.0 | 12.0 | 12.0 | 15.0 | 12.0 | 15.0 |
| Ethylene glycol | — | — | — | — | — | — | — |
| Diethylene glycol | — | — | — | — | — | — | — |
| Propylene glycol | 10.0 | 10.0 | 10.0 | 10.0 | 10.0 | 10.0 | 10.0 |
| Ethanol | — | — | — | 3.0 | — | — | — |
| Isopropyl alcohol | 3.0 | 3.0 | 3.0 | — | — | 3.0 | — |
| Cotton brightener | 0.12 | 0.12 | 0.12 | 0.12 | 0.12 | 0.12 | 0.12 |
| Polyamide brightener | — | — | — | — | — | — | 0.02 |
| Balance: distilled water, dye and perfume, preservatives. | | | | | | | |

| | 10 | 11 | 12 | 13 | 14 |
|---|---|---|---|---|---|
| KA + 3 EO | — | — | — | — | — |
| KA + 12 EO | — | — | — | — | — |
| TA + 5 EO | — | — | — | — | — |
| TA + 14 EO | — | — | — | — | — |
| OCA + 5 EO | 20.0 | 20.0 | 20.0 | 20.0 | 25.0 |
| OCA + 10 EO | 20.0 | 20.0 | 20.0 | 20.0 | 25.0 |
| Soap A | 6.0 | 6.0 | 6.0 | 6.0 | — |
| Soap B | — | — | — | — | 6.0 |
| EDTA | 0.5 | 0.5 | 0.5 | 0.5 | 0.6 |
| Butoxyethanol | — | — | — | 12.5 | — |
| Ethoxyethoxyethanol | — | — | 12.0 | — | — |
| Butoxyethoxyethanol | 12.0 | 12.0 | — | — | 15.0 |
| Ethylene glycol | 10.0 | — | — | — | — |
| Diethylene glycol | — | 10.0 | — | — | — |
| Propylene glycol | — | — | 10.0 | 12.5 | 10.0 |
| Ethanol | 3.0 | — | — | — | — |
| Isopropyl alcohol | — | 3.0 | 3.0 | — | — |
| Cotton brightener | 0.12 | 0.12 | 0.12 | 0.2 | 0.12 |
| Polyamide brightener | 0.02 | 0.02 | — | — | — |
| Clouding agent | — | — | — | 1.0 | — |
| Balance: distilled water, dye and perfume, preservatives. | | | | | |

EXAMPLE 15

When washing textiles in automatic washing machines, using the liquid preparations of the above examples in ratios of 1:40 to 1:100 parts of the wash liquor, a good washing effect was achieved both in hard and in soft wash liquor and at washing temperatures which are at room temperature or below; that is, the water hardness of the wash liquors was in the range of 0° to 30° dH (0 to 300 ppm of calcium oxide) and the temperature of the wash liquor varied between 10° and 60°C.

We claim:

1. A liquid foam-regulated washing and cleansing agent composition containing non-ionic surface-active compounds and organic water-miscible solvents consisting essentially of a. from 30 to 60 percent by weight of a combination of two ethoxylated alcohols having from 12 to 20 carbon atoms selected from the group consisting of alkanols, alkenols and mixtures thereof, where one of the two ethoxylated alcohols is adducted with an average of from 2 to 6 mols of ethylene oxide and the other ethoxylated alcohol is adducted with an average of 8 to 20 mols of ethylene oxide, and where the quantitative ratio of the lower ethoxylated alcohol to the higher ethoxylated alcohol is from 1:3 to 1:1;

b. from 2 to 6 percent by weight of an alkali metal soap of fatty acids with substantially from 12 to 18 carbon atoms;

c. from 0.1 to 1 percent by weight of a water-soluble organic sequestering agent for heavy metal ions;

d. from 20 to 35 percent by weight of a water-miscible solvent combination of a monohydric ether alcohol having from 5 to 8 carbon atoms selected from the group consisting of alkoxyalkanols and alkoxyalkoxyalkanols, and a diol having from 2 to 6 carbon atoms selected from the group consisting of alkanediols and alkoxyalkanediols, said alcohol and said diol having boiling points of over 160°C and flash points of over 60°C and the quantitative ratio of said alcohol to said diol being from 2:1 to 1:2, with the proviso that up to 3 percent by weight, based on the total composition, of said monohydric ether alcohol is replaced with a monohydric alcohol selected from the group consisting of ethanol and isopropyl alcohol; and e. at least 8 percent by weight up to the balance of 100% by weight, of water.

2. The washing and cleansing composition of claim 1 wherein, in component (a), said two ethoxylated alcohols are ethoxylated products of straight-chained primary alcohols having from 12 to 18 carbon atoms.

3. The washing and cleansing composition of claim 1 wherein, in component (a), one of said two ethoxylated alcohols is adducted with an average of from 3 to 5 mols of ethylene oxide and the other ethoxylated alcohol is adducted with an average of 10 to 15 mols of ethylene oxide.

4. The washing and cleansing composition of claim 1 wherein, in component (a), the quantitative ratio of said lower ethoxylated alcohol to said higher ethoxylated alcohol is from 1:2 to 1:1.

5. The washing and cleansing composition of claim 1 wherein the amount of component (a) is from 35 to 45 percent by weight, the amount of component (b) is from 4 to 6 percent by weight, the amount of component (c) is from 0.3 to 0.5 percent by weight.

6. The washing and cleansing composition of claim 1 wherein the amount of component (d) is from 25 to 30 percent by weight.

7. The washing and cleansing composition of claim 1 wherein, in component (d), said quantitative ratio of said alcohol to said diol is from 3:2 to 1:1.

8. The washing and cleansing composition of claim 1 wherein, in component (d), said monohydric ether alcohol is n-butoxyethoxyethanol and said diol is 1,2-propanediol.

9. The washing and cleansing composition of claim 1 wherein, in component (d), up to 3 percent by weight, based on the total composition, of said monohydric ether alcohol is replaced by ethanol.

10. The washing and cleansing composition of claim 1 wherein, in component (d), up to 3 percent by weight, based on the total composition, of said monohydric ether alcohol is replaced by isopropyl alcohol.

11. The washing and cleansing composition of claim 10 wherein from 0.15 to 0.25 percent by weight of perfume is additionally contained in said composition.

12. The washing and cleansing composition of claim 1 wherein said composition contains up to 1 percent by weight of an optical brightener.

13. The washing and cleansing composition of claim 1 wherein the amount of component (a) is from 35 to 45 percent by weight of two ethoxylated alcohols having from 12 to 18 carbon atoms where said alcohols are straight-chained, primary alcohols, one of said ethoxylated alcohols being adducted with an average of from 3 to 5 mols of ethylene oxide and the other, with an average of 10 to 15 mols of ethylene oxide, with the quantitative ratio between said lower ethoxylated alcohol to said higher ethoxylated alcohol being from 1:2 to 1:1; the amount of component (b) is from 4 to 6 percent by weight, the amount of component (c) is from 0.3 to 0.5 percent by weight; and the amount of component (d) is from 25 to 30 percent by weight where the quantitative ratio of said alcohol to said diol is from 3:2 to 1:1.

* * * * *